US011788223B2

(12) United States Patent
Kim et al.

(10) Patent No.: US 11,788,223 B2
(45) Date of Patent: Oct. 17, 2023

(54) DRUM WASHING MACHINE

(71) Applicant: Samsung Electronics Co., Ltd., Suwon-si (KR)

(72) Inventors: Yongkwon Kim, Suwon-si (KR); Youngjin Cho, Suwon-si (KR); Sangyoung Kweon, Suwon-si (KR); Jonghun Sung, Suwon-si (KR); Jihoon Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 221 days.

(21) Appl. No.: 17/274,366

(22) PCT Filed: Sep. 9, 2019

(86) PCT No.: PCT/KR2019/011614

§ 371 (c)(1),
(2) Date: Mar. 8, 2021

(87) PCT Pub. No.: WO2020/055055

PCT Pub. Date: Mar. 19, 2020

(65) Prior Publication Data

US 2021/0332521 A1 Oct. 28, 2021

(30) Foreign Application Priority Data

Sep. 11, 2018 (KR) ..... 10-2018-0108029

(51) Int. Cl.
*D06F 37/06* (2006.01)
*D06F 39/08* (2006.01)

(52) U.S. Cl.
CPC ..... *D06F 37/06* (2013.01); *D06F 39/08* (2013.01)

(58) Field of Classification Search
CPC ..... D06F 37/06; D06F 39/08
See application file for complete search history.

(56) References Cited

U.S. PATENT DOCUMENTS

2005/0252253 A1 11/2005 Ahn
2007/0289116 A1* 12/2007 Ratfisch ..... B29C 66/742 29/432

(Continued)

FOREIGN PATENT DOCUMENTS

CN 206368272 U 8/2017
EP 2 489 773 B1 12/2013

(Continued)

OTHER PUBLICATIONS

Machine translation of KR 10-0713946 B1. (Year: 2007).*

(Continued)

*Primary Examiner* — Joseph L. Perrin
(74) *Attorney, Agent, or Firm* — STAAS & HALSEY LLP

(57) ABSTRACT

A front-loading washing machine includes a housing; a washing tub including one or more locking holes on a lateral side; and one or more lifters lifting up laundry based on spinning of the washing tub. The lifter includes a locking member passing through the locking hole, bent at an outside of the washing tub and extended in a spinning axis direction of the washing tub. The locking hole includes a first edge to which the locking member is locked to couple the lifter and the washing tub, and a second edge and a third edge adjacent to opposite ends of the first edge and surrounding the locking member to face with each other.

7 Claims, 15 Drawing Sheets

(56) References Cited

U.S. PATENT DOCUMENTS

| | | | | |
|---|---|---|---|---|
| 2008/0282747 | A1* | 11/2008 | Kim | D06F 37/065 68/13 R |
| 2008/0302140 | A1* | 12/2008 | Jeong | D06F 37/02 68/142 |
| 2009/0071202 | A1* | 3/2009 | Lee | D06F 37/06 68/212 |
| 2009/0120139 | A1* | 5/2009 | Bobed | D06F 58/04 68/142 |
| 2013/0081432 | A1* | 4/2013 | Choi | D06F 37/14 68/142 |
| 2017/0191202 | A1* | 7/2017 | Lee | D06F 37/06 |
| 2019/0048512 | A1* | 2/2019 | Noh | D06F 37/06 |

FOREIGN PATENT DOCUMENTS

| | | | |
|---|---|---|---|
| KR | 10-2005-0108607 | A | 11/2005 |
| KR | 10-0665510 | B1 | 1/2007 |
| KR | 10-0713946 | B1 | 5/2007 |
| KR | 10-2007-0090637 | A | 9/2007 |
| KR | 20-2011-0008118 | | 8/2011 |
| KR | 10-1185955 | B1 | 9/2012 |
| KR | 10-2012-0136800 | A | 12/2012 |
| KR | 20140084947 | A * | 7/2014 |
| KR | 10-2015-0094502 | A | 8/2015 |
| KR | 10-1699748 | B1 | 1/2017 |

OTHER PUBLICATIONS

Machine translation of KR 10-2012-0136800 A. (Year: 2012).*

International Search Report dated Jan. 8, 2020, in corresponding International Patent Application No. PCT/KR2019/011614.

Extended European Search Report in Application No. 19860295.5 dated May 17, 2021.

Office Action, dated Dec. 13, 2022, in corresponding Korean Patent Application No. 10-2018-0108029.

Communication pursuant to Article 94(3) EPC, dated Feb. 6, 2023, in corresponding European Patent Application No. 19860295.5.

Office Action dated Jun. 27, 2023, issued in Korea Application No. 10-2018-0108029.

* cited by examiner

DRUM WASHING MACHINE

CROSS-REFERENCE TO RELATED APPLICATIONS

This application is a U.S. National Stage Application which claims the benefit under 35 U.S.C. § 371 of International Patent Application No. PCT/KR2019/011614 filed on Sep. 9, 2019, which claims foreign priority benefit under 35 U.S.C. § 119 of Korean Patent Application 10-2018-0108029 filed on Sep. 11, 2018, in the Korean Intellectual Property Office, the contents of both of which are incorporated herein by reference.

TECHNICAL FIELD

The disclosure relates to a drum type washing machine with a washing tub which spins with respect to an axis line substantially parallel to an installation surface, and more particularly to a drum type washing machine having a structure by which a lifter provided inside a washing tub is coupled to the washing tub.

BACKGROUND ART

A washing machine refers to an apparatus that includes a washing tub into which laundry such as cloth, clothes, bedclothes, etc. is loaded, and does the laundry in the washing tub by driving the washing tub to spin with a motor. The washing machine may be classified into two of a top-loading washing machine and a front-loading washing machine according to dispositions of the washing tub. In the top-loading washing machine, a vertical shaft is connected to the washing tub which is disposed in a substantially vertical direction, and a pulsator is provided inside the washing tub. While the washing tub of the top-loading washing machine is spinning forward and backward with respect to the vertical shaft, the laundry gets clean based on water flow generated by the pulsator. On the other hand, in the front-loading washing machine, a horizontal shaft is connected to the washing tub which is disposed in a substantially horizontal direction. While the washing tub of the front-loading washing machine is spinning forward and backward with respect to a horizontal shaft, laundry gets clean based on collision due to a fall as the laundry is lifted up along the inner circumferential surface of the washing tub and then falls.

In the front-loading washing machine, the laundry needs to be lifted up in the washing tub in order to improve an effect on washing the laundry. However, the front-loading washing machine has the washing tub of which the spinning shaft is substantially horizontal, and only the spinning force of the washing tub is not enough to lift the laundry from the lower side to the upper side of the washing tub. Therefore, the front-loading washing machine further includes one or more lifters provided inside the washing tub in order to lift the laundry. When the washing tub spins during a washing process, the lifter lifts up the laundry so that the laundry can fall on the bottom of the washing tub while having friction with water.

The washing tub and the lifter may be provided as a single body. However, in this case, a manufacturer has to make the shape of the lifter on the inside of the washing tub, and therefore a production line is increased in terms of manufacture. Further, as the front-loading washing machine operates, the washing tub increases a spinning speed and also increases in centrifugal force. When the lifter and the washing tub are provided as the single body, the centrifugal force causes the lifter or the washing tub to be noticeably deformed. Accordingly, the washing tub and the lifter are separately provided, and the lifter is coupled to the inside of the washing tub.

Although the washing tub and the lifter are separately provided, the washing tub and the lifter are affected by the centrifugal force based on the spin of the washing tub. As the use time of the front-loading washing machine increases, stress caused by the centrifugal force is accumulated in a coupling region of the washing tub to which the lifter is coupled, thereby bringing about deformation in the coupling region. Accordingly, the front-loading washing machine having a structure, in which the washing tub and the lifter are coupled, is required to prevent the deformation in the coupling region.

DISCLOSURE

Technical Solution

A front-loading washing machine according to an embodiment of the disclosure includes a housing including a door to be opened and closed on a front; a washing tub provided to be spinnable inside the housing, shaped like a cylinder opened toward the front facing the door, and including one or more locking holes on a lateral side; and one or more lifters provided inside the washing tub, coupled to the washing tub through the locking holes, and lifting up laundry based on spinning of the washing tub, the lifter including a locking member passing through the locking hole, bent at an outside of the washing tub and extended in a spinning axis direction of the washing tub, and the locking hole including a first edge to which the locking member is locked to couple the lifter and the washing tub, and a second edge and a third edge adjacent to opposite ends of the first edge and surrounding the locking member to face with each other.

Here, the locking member may be provided to be locked to a certain region of the washing tube forming the first edge.

Further, the locking member may include: an erect portion erectly extended from a bottom of the lifter and provided to be in contact with the first edge, an end portion bent from the erect portion in the spinning axis direction, and an inclined portion provided between the erect portion and the end portion, and inclined at a predetermined angle to an axis line of the spinning axis direction.

Further, the locking hole may have a bilateral symmetry with respect to an axis line passing through a center of the locking hole in the spinning axis direction.

Here, the locking hole may include a rectangular shape.

Further, the locking hole may include corners rounded to have a predetermined diameter.

Further, the lifter may include a fastening boss protruding from a bottom of the lifter, and the washing tub may include a fastening hole to be fastened with the fastening boss by a screw.

Here, the front-loading washing machine may further include a water tank including a water supplying hole to which a supplying pipe for supplying wash water is coupled, and accommodating the washing tub therein, wherein the fastening hole is positioned corresponding to a position of the water supplying hole.

Further, a front-loading washing machine according to an embodiment of the disclosure include a housing including a door to be opened and closed on a front; a washing tub provided to be spinnable inside the housing, shaped like a cylinder opened toward the front facing the door, and including one or more locking holes on a lateral side; and one or more lifters provided inside the washing tub, coupled to the washing tub through the locking holes, and lifting up laundry based on spinning of the washing tub, the lifter including an erect portion extended toward the washing tub, and an end portion having a larger diameter than the erect portion, the locking hole including a groove cut in a radial direction of the locking hole from a partial edge of the locking hole. Thus, stress focused on the locking hole is dispersed, thereby preventing a region around the locking hole from being deformed in the washing tub.

BEST MODE

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these plural embodiments may be discretionally selected and applied to realize the present inventive concept by a person having an ordinary skill in the art.

In the description of the embodiments, an ordinal number used in terms such as a first element, a second element, etc. is employed for describing variety of elements, and the terms are used for distinguishing between one element and another element. Therefore, the meanings of the elements are not limited by the terms, and the terms are also used just for explaining the corresponding embodiment without limiting the disclosure.

Further, a term "at least one" among a plurality of elements in the disclosure represents not only all the elements but also each one of the elements, which excludes the other elements or all combinations of the elements.

Figure 1:
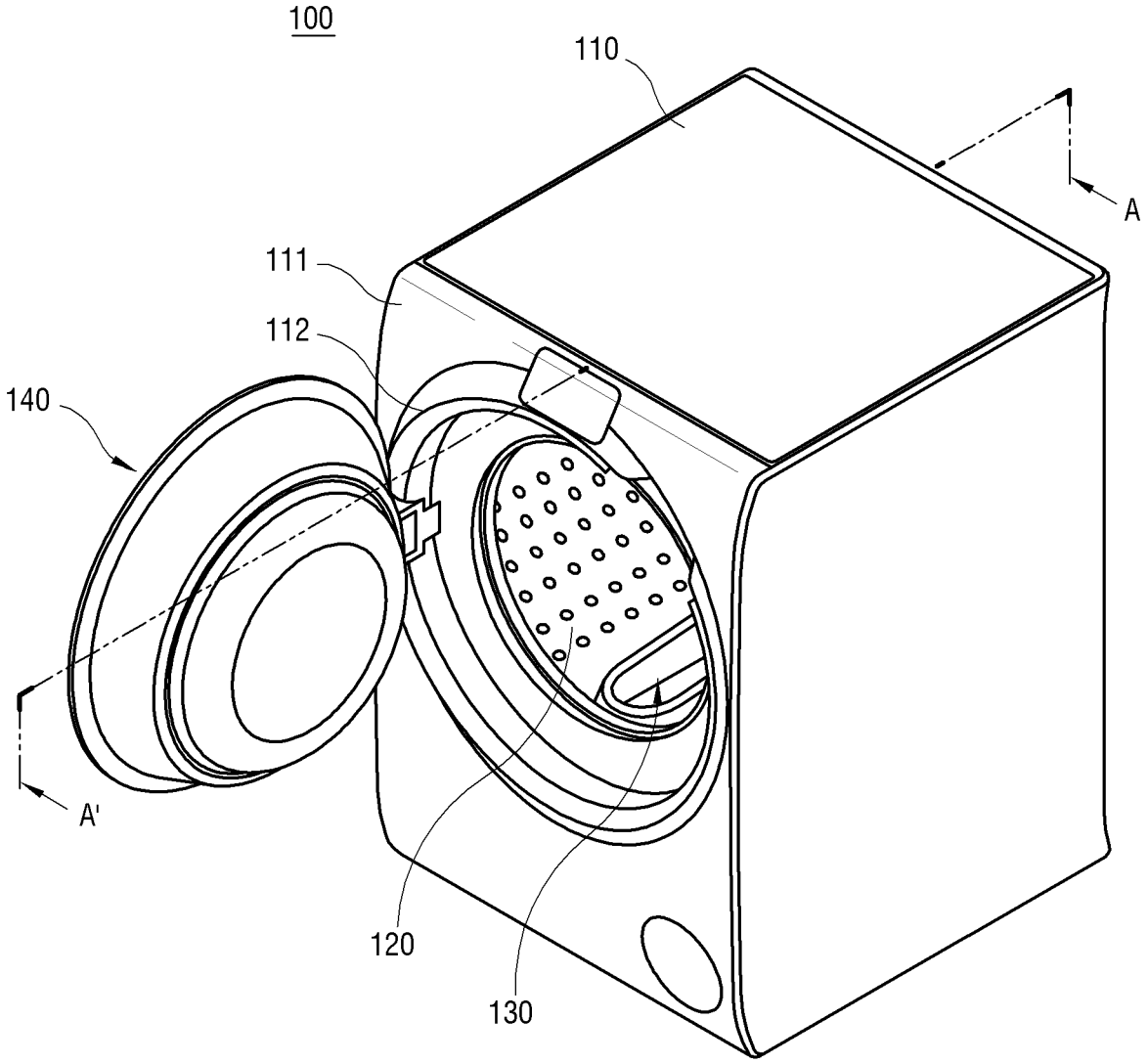
FIG. 1 is a perspective view of a front-loading washing machine according to an embodiment of the disclosure.

FIG. 1 is a perspective view of a front-loading washing machine according to an embodiment of the disclosure.

As shown in FIG. 1, a washing machine according to an embodiment of the disclosure is embodied by a front-loading washing machine 100. On the contrary to a top-loading washing machine with a washing tub that spins with respect to a vertical axis line substantially perpendicular to an installation surface, the front-loading washing machine 100 includes a washing tub 120 that spins with respect to a horizontal axis line substantially parallel with the installation surface. However, the spinning axis for the washing tub 120 is not necessarily horizontal, but may be inclined at a predetermined angle to the horizontal axis line. Due to such differences, the front-loading washing machine 100 is different in a structure and a washing method from the top-loading washing machine, and the following descriptions will be made for the basic structure of the front-loading washing machine 100.

The front-loading washing machine 100 includes a housing 110 forming an outer appearance, the washing tub 120 provided to spin inside the housing 110, and one or more lifters 130 protruding from the inner circumferential surface of the washing tub 120 toward a central axis line of the washing tub 120.

The housing 110 has a schematically hexahedral shape, and a front panel 111 of the housing 110 is formed with a loading hole 112 through which laundry is loaded from the outside. The housing 110 includes a door 140 coupled to the front panel 111 so as to selectively open and close the loading hole 112. The door 140 may for example be coupled to the front panel 111 by a hinge, and rotatably provided between a closed position for closing the loading hole 112 and an open position for opening the loading hole 112. Further, the door 140 includes a handle to be gripped by a user to rotate the door 140.

Terms "front end", "rear end", "lower portion", "upper end", "lower end", etc. used in all the embodiments of the disclosure are defined with reference to the accompanying drawings, and the shapes and positions of the elements are not restricted by these terms.

Figure 2:
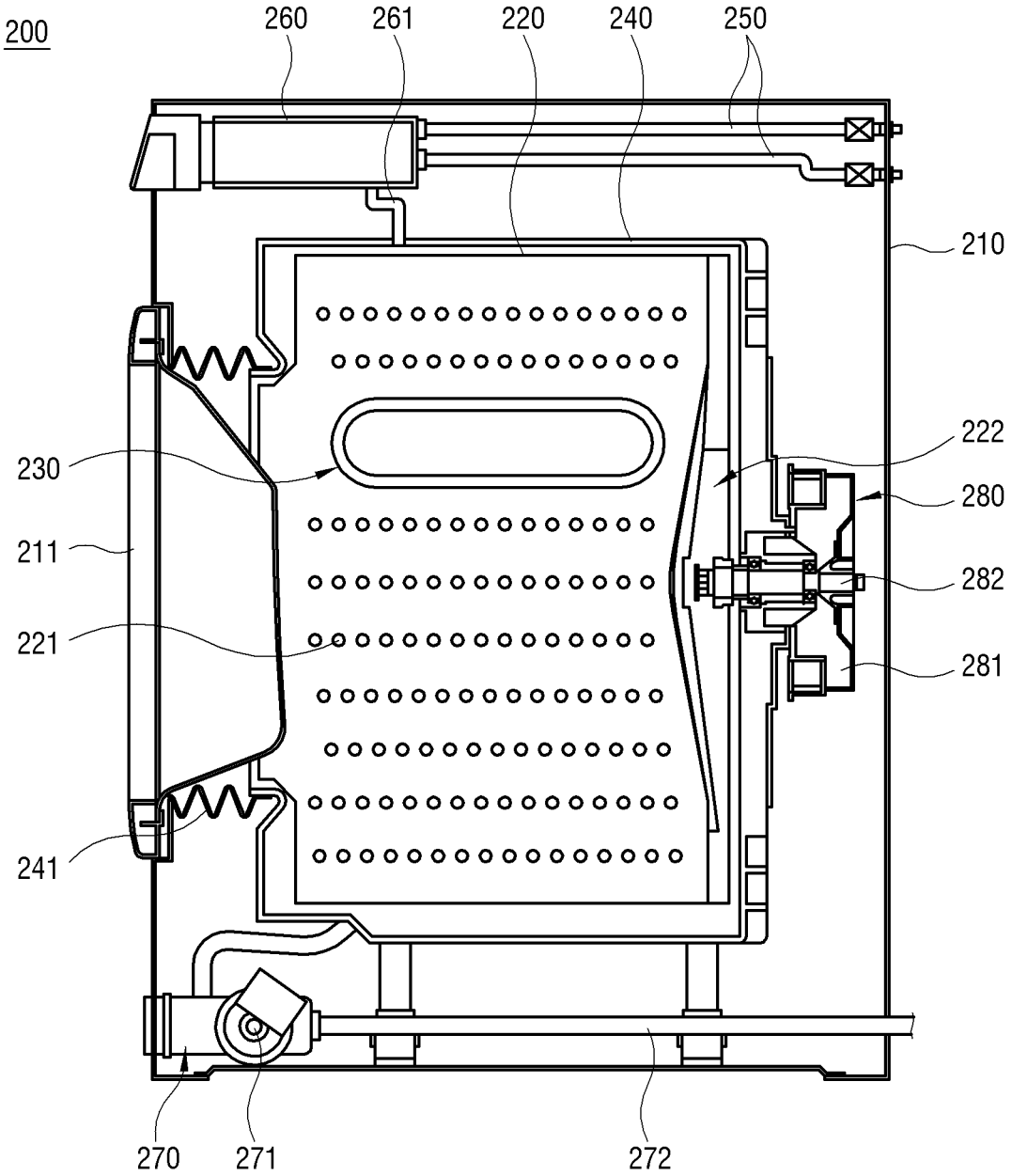
FIG. 2 is a lateral cross-section view of the front-loading washing machine, taken along line A-A' in FIG. 1.

FIG. 2 is a lateral cross-section view of the front-loading washing machine, taken along line A-A' in FIG. 1.

As shown in FIG. 2, the front-loading washing machine 200 includes the housing 210, the washing tub 220, and the lifter 230. The housing 210 includes the door 211 for opening and closing the loading hole. These elements have already been described in the foregoing embodiment.

The front-loading washing machine 200 further includes a water tank 240 to be filled with wash water, a water supplying pipe 250 to supply wash water from an external water source such as a water supply, a detergent supplier 260 to add detergent to the wash water supplied through the water supplying pipe 250, a drainage 270 to drain the wash water from the inside of the water tank 240 to the outside, and a driver 280 to drive the washing tub 220.

Meanwhile, the washing tub 220 is provided to spin inside the water tank 240, and is formed with a loading hole on the front thereof. The loading hole of the washing tub 220 is disposed to be aligned with the loading hole of the housing 210, so that the laundry put through the loading hole of the housing 210 can be loaded into the washing tub 220. The washing tub 220 includes a plurality of holes 221 formed on and passing through the outer circumferential surface thereof to allow wash water to flow in and out. Through the hole 221, the inner space of the washing tub 220 communicates with the inner space of the water tank 240. Further, the washing tub 220 includes a rear frame 222 coupled to the driver 280 so that the washing tub 220 can spin based on driving power of the driver 280.

The water tank 240 accommodates the washing tub 220 therein, and is disposed to be horizontal or inclined at a predetermined angle to a horizontal line inside the housing 210 so as to be filled with wash water during a washing process. The water tank 240 includes the loading hole formed on the front thereof facing toward the door 211. The water tank 240 includes a diaphragm 241 interposed between the loading hole of the housing 210 and the loading hole of the water tank 240. The diaphragm 241 prevents wash water in the water tank 240 from leaking, allows position change of the water tank 240, and absorbs vibration of the water tank 240 when the door 211 is in the closing position.

The water supplying pipe 250 serves as a channel for supplying wash water to the water tank 240 and is placed above the water tank 240. The water supplying pipe 250 includes one end connecting and communicating with the external water source, and the other end connecting and communicating with the detergent supplier 260.

The detergent supplier 260 communicates with the water tank 240 through a supplying pipe 261. Water supplied through the water supplying pipe 250 is mixed with detergent via the detergent supplier 260, and the water mixed with the detergent is supplied into the water tank 240 through the supplying pipe 261. The water tank 240 includes a hole with which the water supplying pipe 250 connects and communicates, and the water supplying pipe 250 is coupled to this hole so that wash water can be supplied to the water tank 240.

The drainage 270 is placed below the water tank 240 and drains the wash water from the inside of the water tank 240 to the outside of the housing 210. The drainage 270 includes a drain pump 271 to generate pneumatic pressure to drain the wash water to the outside, and a drain hose 272 connecting and communicating with the drain pump 271 and serving as a channel for wash water from the inside of the water tank 240 to the outside of the housing 210.

The driver 280 is disposed behind the washing tub 220. The driver 280 includes a motor 281 to generate the driving power, and a spinning shaft 282 connecting the motor 281 and the rear frame 222 to transfer the driving power from the motor 281 to the washing tub 220. The driving power generated as the motor 281 rotates forward and backward is transferred to the washing tub 220 through the spinning shaft 282, so that the washing tub 220 spins forward and backward based on the driving power, thereby washing the laundry in the washing tub 220.

The lifter 230 protrudes from the inner circumferential surface of the washing tub 220 toward the center of the washing tub 220, and a plurality of lifters 230 are spaced apart from each other at predetermined intervals along the inner circumferential surface of the washing tub 220. The lifter 230 lifts the laundry up to a predetermined height in the washing tub 220 as the laundry is caught in the lifter 230 when the washing tub 220 spins, and moves the laundry so that wash water can smoothly flow, thereby improving an effect on washing the laundry.

The lifter 230 is extended to have a predetermined length in a direction parallel with the spinning axis line of the washing tub 220. In other words, the lengthwise direction of the lifter 230 is parallel with the spinning axis line of the washing tub 220. The lifter 230 may have a linear structure of which the width is uniform along the lengthwise direction, a concave structure of which the width in a middle region is narrower than those at opposite ends, or a convex structure of which the width in the middle region is wider than those at the opposite ends.

Figure 3:
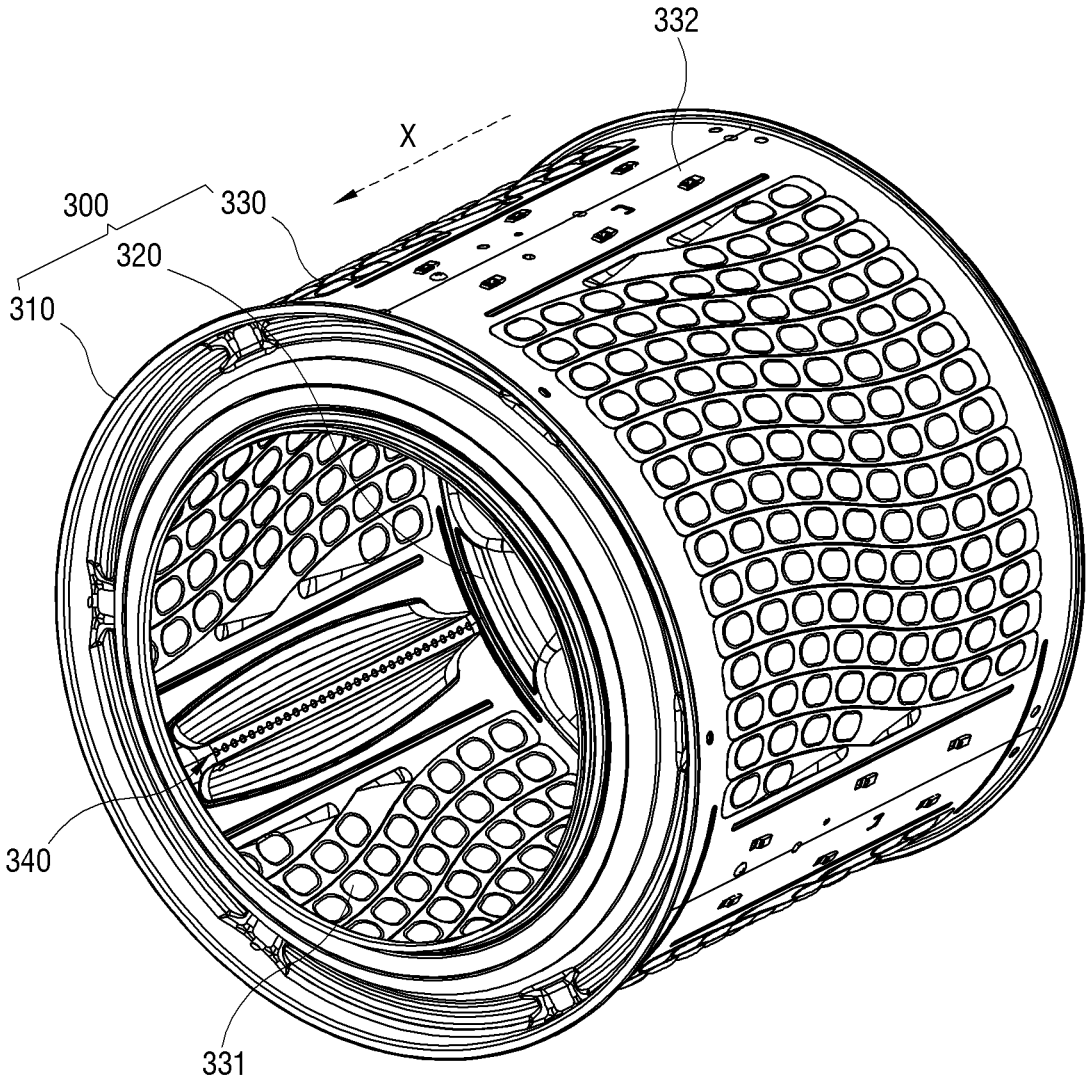
FIG. 3 is a perspective view of a washing tub of a front-loading washing machine according to an embodiment of the disclosure.

FIG. 3 is a perspective view of a washing tub of a front-loading washing machine according to an embodiment of the disclosure.

As shown in FIG. 3, the washing tub 300 according to an embodiment has a cylindrical shape. The washing tub 300 includes a front frame 310 shaped like a ring with an opening, a rear frame 320 shaped like a disk disposed in parallel with the front frame 310 and having a diameter similar to that of the front frame 310, and a wrapper 330 forming a wall of the washing tub 300 between the front frame 310 and the rear frame 320.

The opening of the front frame 310 in the front of the washing tub 300 is aligned with the opening of the housing, so that a user can put laundry into or take the laundry out of the washing tub 300. The front frame 310 and the rear frame 320 respectively support the front and rear ends of the rolled wrapper 330, so that the washing tub 300 can have a cylindrical shape.

The rear frame 320 spins based on the driving power of the driver as its back is connected to the driver. The rear frame 320 couples with the front frame 310 and the wrapper 330, and therefore the washing tub 300 spins forward and backward based on the driving power with respect to a predetermined axis line in the X direction. The X direction refers to a direction substantially parallel with an installation surface such as a floor on which the front-loading washing machine is installed, i.e. refers to a horizontal direction. However, the spinning axis line of the washing tub 300 is not necessarily parallel with the axis line of the X direction, but may be inclined at a predetermined angle to the axis line of the X direction.

The wrapper 330 is manufactured as a rectangular plate having a plurality of holes 331 is rolled with respect to the spinning axis of the washing tub 300 and its both sides are coupled. The holes 331 are provided to allow wash water filled in the water tank to flow in and out of the washing tub 300. On the inner circumferential surface of the wrapper 330, one or more lifters 340 are arranged being extended in the X direction. In this embodiment, it is described by way of example that three lifters 340 are symmetrically spaced apart from each other with respect to the spinning axis of the washing tub 300, but the number of lifters 340 and the space between the lifters 340 are not limited to this embodiment.

The lifters 340 are coupled to the inner circumferential surface of the wrapper 330, protruding toward the spinning axis of the washing tub 300. The lifter 340 hits and lifts up laundry by the left and right sides of the protruding structure thereof when the washing tub 300 spins. The laundry hit and lifted up by the lifter 340 falls and collides with the wrapper 330. Such operations are repeated to do the laundry.

The lifter 340 has a structure separated from the wrapper 330, and therefore each of the lifter 340 and the wrapper 330 needs to have a coupling structure 332 in order to couple the lifter 340 and the wrapper 330. Below, the coupling structure 332 will be described.

Figure 4:
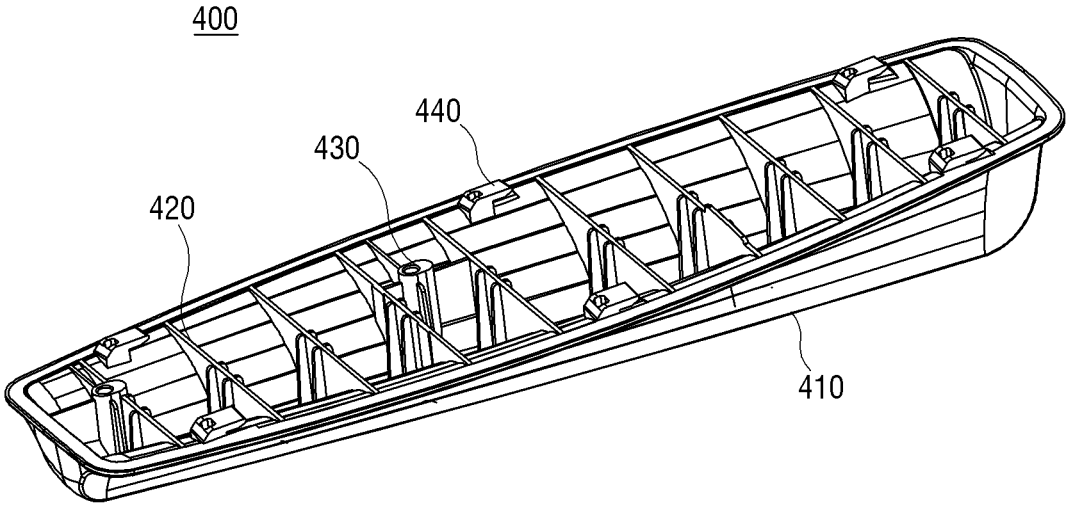
FIG. 4 is a perspective view showing a bottom of a lifter used for a front-loading washing machine according to an embodiment of the disclosure.

FIG. 4 is a perspective view showing a bottom of a lifter used for a front-loading washing machine according to an embodiment of the disclosure.

As shown in FIG. 4, a lifter 400 serves to lift up laundry that collides with the outside of the lifter 400, and the inside of the lifter 400 forms an empty space to reduce weight.

The lifter 400 includes a lifter housing 410 forming an outer appearance, a support rib 420 provided inside the lifter housing 410 and supporting the lifter housing 410, a fastening boss 430 protruding from the bottom of the lifter housing 410 and provided to be fastened with a screw, and a locking member 440 protruding from the bottom of the lifter housing 410 and provided to be locked to the washing tub.

The lifter housing 410 forms the outer appearance of the lifter 400 convexedly protruding from the washing tub, when the lifter 400 is coupled to the washing tub.

The support rib 420 is provided inside the lifter housing 410 and extended in a direction perpendicular to the lengthwise direction of the lifter housing 410. A plurality of support ribs 420 are arranged in parallel with each other along the length of the lifter housing 410 so as to reinforce the lifter housing 410 which is empty.

The screw fastens the lifter 400 and the washing tub through the fastening boss 430, but an element for substantially fastening the lifter 400 to the washing tub is the locking member 440. Alternatively, the lifter 400 may be designed not to include the fastening boss 430.

In this embodiment, it will be described that six locking members 440 are symmetrically arranged along the lengthwise direction of the lifter 400. There are no limits to the position and number of locking member 440 on the bottom of the lifter housing 410. Every locking member 440 has the same structure.

Below, the shape of the locking member 440 will be described in detail.

Figure 5:
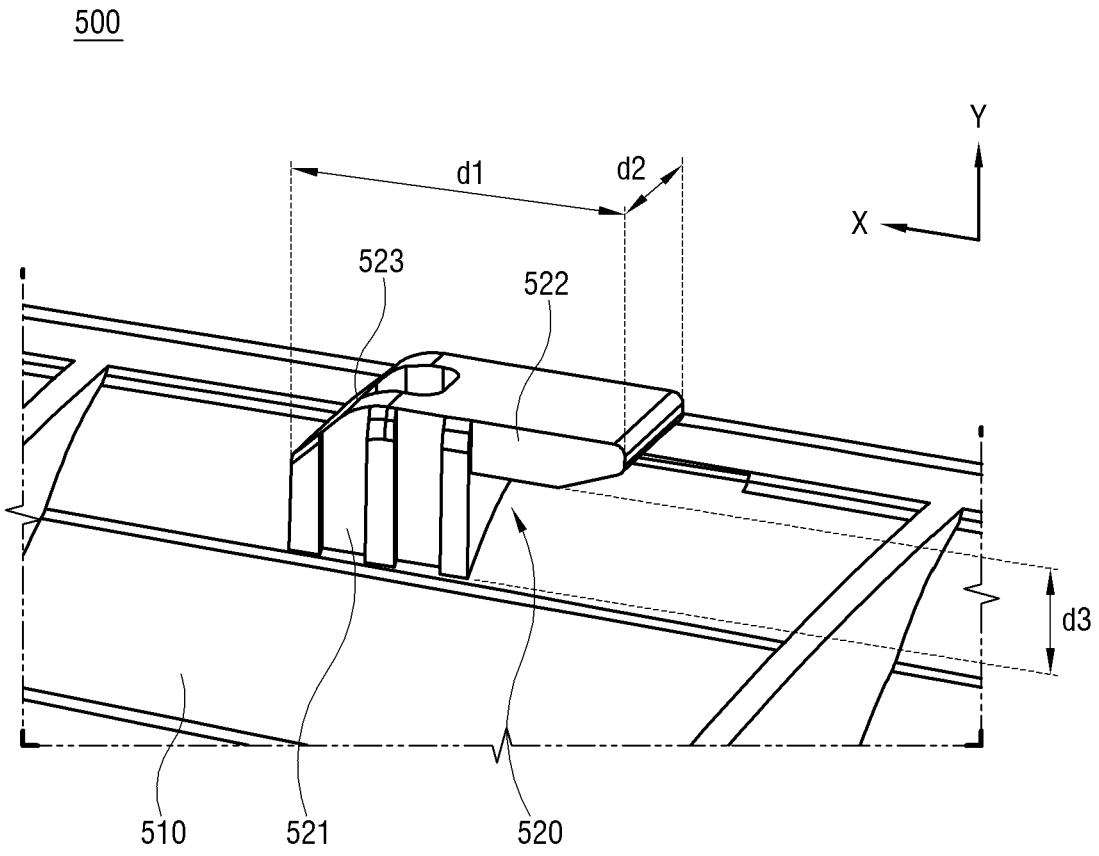
FIG. 5 is an enlarged partial perspective view of a certain locking member on the bottom of the lifter in FIG. 4.

FIG. 5 is an enlarged partial perspective view of a certain locking member on the bottom of the lifter in FIG. 4.

As shown in FIG. 5, a lifter 500 according to an embodiment includes a lifter housing 510, and a locking member 520 protruding from the bottom of the lifter housing 510 and shaped like a hook. First, X and Y directions in the accompanying drawings are as follows. The X direction refers to not only the spinning axial direction of the washing tub, but also the lengthwise direction of the lifter 500. The Y direction refers to not only the direction orthogonal to the X direction, but also the radial direction with respect to the spinning axis of the washing tub.

The locking member 520 includes an erect portion 521 extended along the Y direction from the bottom of the lifter housing 510 extended in parallel with the X direction, and an end portion bent from the erect portion 521 and extended in the −X direction. In other words, the locking member 520 includes the erect portion 521 and the end portion 522, which are extended perpendicularly to each other, thereby generally forming a hook shape oriented in the −X direction. The locking member 520 shaped like a hook may be divided into a region extended in the Y direction corresponding to the erect portion 521, and a region extended in the −X direction corresponding to the end portion 522. A bent region of the locking member 520 from the erect portion 521 toward the end portion 522 forms an inclined portion 523 so that the locking member 520 can be easily inserted in the locking hole of the washing tub.

For convenience, the X direction is oriented from the inside of the washing tub toward the front of the front-loading washing machine, and therefore the −X direction refers to a direction in which a user opens the door on the front of the front-loading washing machine and looks inside the washing tub.

The total length d1 of the end portion 522 in the X direction is provided corresponding to the length the locking hole of the washing tub has. The end portion 522 needs to pass through the locking hole of the washing tub, and a space between edges of the locking hole of the washing tub and the end portion 522 facing each other should be within a preset allowable range. When the end portion 522 is much longer than the locking hole of the washing tub, it is impossible to insert the lifter 500 in the washing tub. Further, when the space between the end portion 522 and the locking hole of the washing tub is greater than the allowable range, i.e. when the length of the end portion 522 is much smaller than the length of the locking hole of the washing tub, the lifter 500 is not strongly coupled to the washing tub. Likewise, this principle is also applied between the width d2 of the end portion 522 and the width of the locking hole of the washing tub.

The distance d3 between the bottom of the lifter housing 510 and the end portion 522 corresponds to the thickness of the washing tub. When d3 is smaller than the thickness of the washing tub, it is impossible to completely couple the lifter 500 to the washing tub even though the end portion 522 passes through the locking hole of the washing tub. In other words, to completely couple the lifter 500 and the washing tub, d3 should be greater than the thickness of the washing tub, and the space between d3 and the thickness of the washing tub should be smaller than a preset allowable range. However, d3 may be designed considering that d3 is extendable a little as the locking member 520 is elastically deformed by external force.

Such numerical values of the portions of the locking member 520 are not limited to specific values, but may vary depending on the size and material of the washing tub, the size and material of the locking member 520, revolutions per minute (RPM) of the washing tub, and the like various characteristics of the front-loading washing machine.

Below, a structure of the washing tub to which the locking member 520 is locked will be described.

Figure 6:
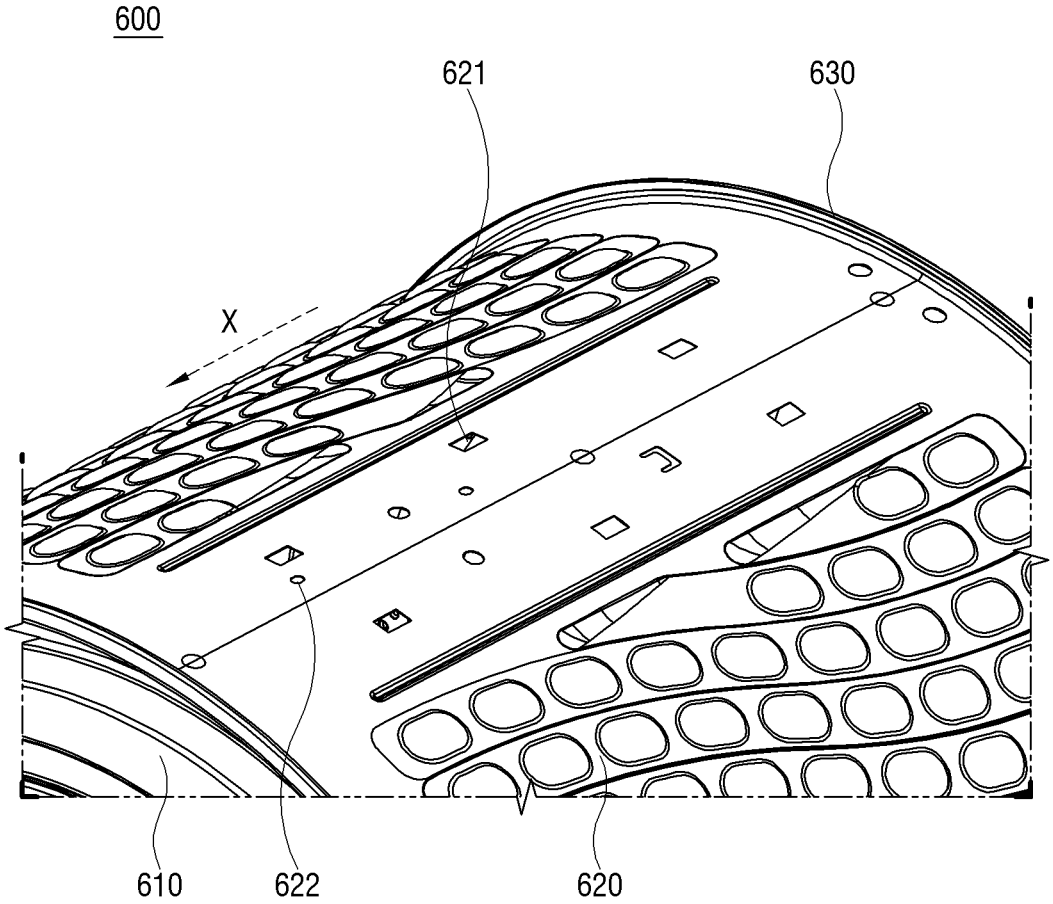
FIG. 6 is a partial perspective view showing a structure for coupling with a lifter on an outer circumferential surface of a washing tub in a front-loading washing machine according to an embodiment of the disclosure.

FIG. 6 is a partial perspective view showing a structure for coupling with a lifter on an outer circumferential surface of a washing tub in a front-loading washing machine according to an embodiment of the disclosure.

As shown in FIG. 6, a washing tub 600 includes a front frame 610, a wrapper 620, and a rear frame 630. On the surface of the wrapper 620, a coupling portion for coupling with the lifter is formed. The coupling portion includes a locking hole 621 formed by penetrating the wrapper 620 to accommodate the locking member of the lifter, and a screw fastening hole 622 formed by penetrating the wrapper 620 to correspond to the fastening boss of the lifter. The positions and number of locking holes 621 and screw fastening holes 622 correspond to those of the locking member and the fastening boss of the lifter, respectively. In this embodiment, only one locking hole 621 will be representatively described, and repetitive descriptions about the same other locking holes 621 will be avoided.

When the X direction is parallel with the spinning axis of the washing tub 600, the locking hole 621 has a bilateral symmetry with respect to the X directional axis line passing through the center of the locking hole 621. For example, the locking hole 621 has a rectangular or square shape. Details of coupling the lifter to the washing tub 600 through the locking hole 621 will be described later.

When the lifter is coupled to the washing tub 600, the screw fastening hole 622 is fastened to the fastening boss of the lifter by the screw. The screw is fastened to the fastening boss of the lifter via the screw fastening hole 622 from the outer circumferential surface of the washing tub 600.

Below, it will be described that the lifter is coupled to the washing tub 600 by the locking hole 621.

Figure 7:
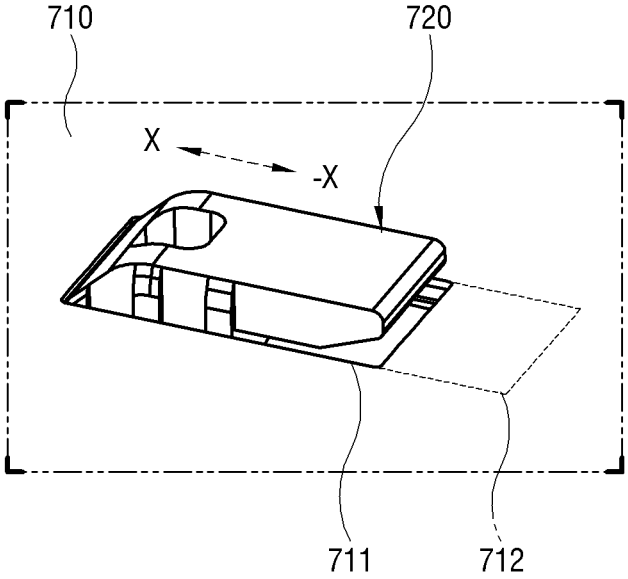
FIG. 7 is a partial perspective view showing a state that a locking member of the lifter is accommodated in a locking hole on the outer circumferential surface of the washing tub in FIG. 6.

FIG. 7 is a partial perspective view showing a state that a locking member of the lifter is accommodated in a locking hole on the outer circumferential surface of the washing tub in FIG. 6.

As shown in FIG. 7, a locking member 720 from an inner circumferential surface of a washing tub 710 passes through a locking hole 711, and appears on an outer circumferential surface of the washing tub 710. In this state, the locking member 720 only passes through the locking hole 711, and therefore the lifter is not coupled to the washing tub 710. To couple the lifter to the washing tub 710, a user pushes the lifter from this state in the −X direction and thus the locking member 720 moves to the −X direction. Here, the X direction and the −X direction are in parallel with the spinning axis of the washing tub 710, in which the X direction is oriented from the inside of the washing tub 710 toward the front of the front-loading washing machine, and the −X direction is opposite to the X direction. The end portion of the locking member 720 shown in the accompanying drawing faces in the −X direction.

As described above, the locking hole 711 has a bilateral symmetry with respect to the X directional axis line passing through the center of the locking hole 711. In this embodiment, the locking hole 711 has a rectangular shape extended in the X direction, in which a region 712 adjacent to the locking hole 711 in the −X direction among the regions of the washing tub 710 adjacent to the four edges of the locking hole 711 serves to support the locking member 720.

Figure 8:
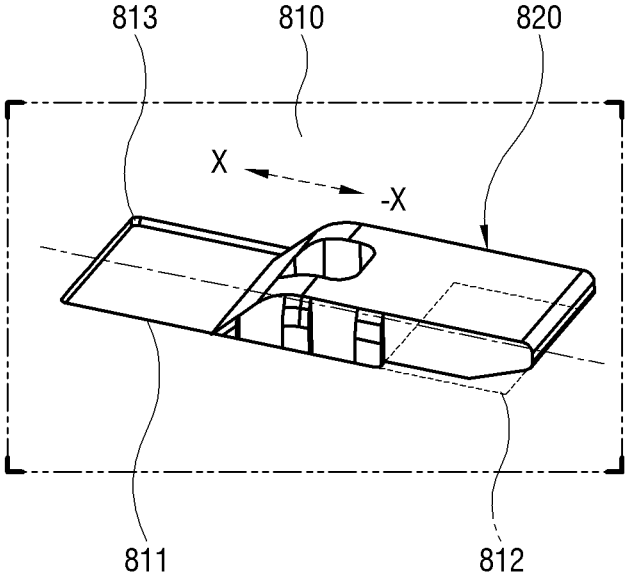
FIG. 8 is a partial perspective view showing a state after the locking member is pushed in a −X direction from the state of FIG. 7.

FIG. 8 is a partial perspective view showing a state after the locking member is pushed in a −X direction from the state of FIG. 7.

Figure 9:
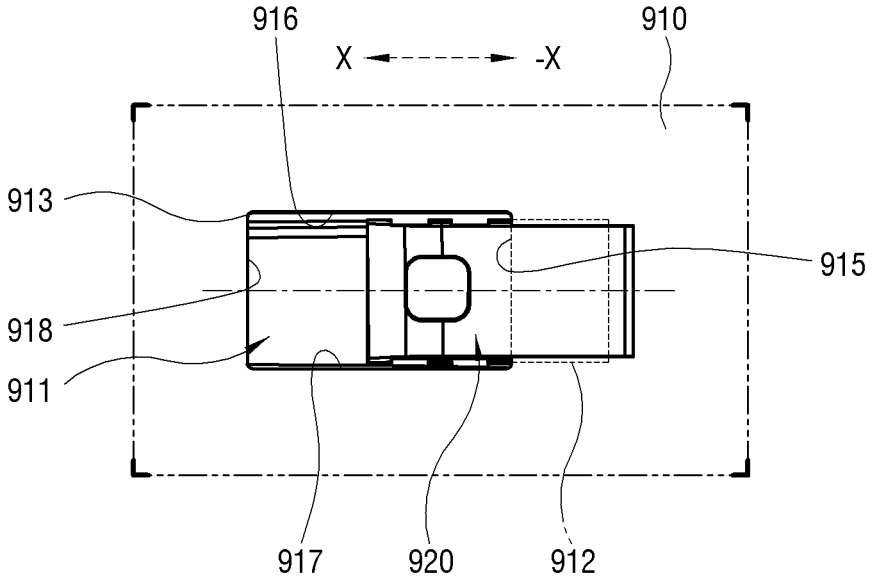
FIG. 9 is a plan view showing a state after the locking member is pushed in a −X direction from the state of FIG. 7.

FIG. 9 is a plan view showing a state after the locking member is pushed in a −X direction from the state of FIG. 7.

As shown in FIG. 8 and FIG. 9, a locking member 820, 920 accommodated in a locking hole 811, 911 is moved in the −X direction by external force. An end portion lower surface of the locking member 820, 920 is in contact with the region 812, 912 positioned at the edge of the locking hole 811, 911 in the −X direction among four regions on the external circumferential surface of a washing tub 810, 910, which form four edges of the locking hole 811, 911 having a rectangular shape. When the locking member 820, 920 moves until the erect portion of the locking member 820, 920 is in contact with the edge of the locking hole 811, 911 in the −X direction, the end portion of the locking member 820, 920 is supported by the corresponding region 812, 912 of the washing tub 810, 910, thereby coupling the lifter to the washing tub 810, 910.

In other words, in the coupling structure of the lifter and the washing tub 810, 910 according to an embodiment of the disclosure, the end portion of the locking member 820, 920 of the lifter faces in the −X direction, and the locking hole 811, 911 has a bilateral symmetry with respect to a central axis line in the X direction passing through the center of the locking hole 811, 911.

The locking hole 811, 911 is formed by a first edge 915 in the −X direction, a second edge 916 orthogonally adjacent to the first edge 915, a third edge 917 orthogonally adjacent to the first edge 915 and facing the second edge 916, and a fourth edge 918 orthogonally adjacent to the second edge 916 and the third edge 917 and facing the first edge 915. The locking member 820, 920 is in contact with and supported by the first edge 915 among these four edges 915, 916, 917 and 918. In other words, for the coupling, the end portion of the locking member 820, 920 is locked to a certain region 912 of the washing tub forming the first edge 915.

When the washing tub 810, 910 spins in the state that the locking member 820, 920 is coupled to the washing tub 810, 910, the locking member 820, 920 is supported by the second edge 916 and the third edge 917. In other words, the locking member 820, 920 is supported by the second edge 916 when the washing tub 810, 910 spins in a forward direction, but supported by the third edge 917 when the washing tub 810, 910 spins in a backward direction. Here, the forward direction and the backward direction are just given to represent the opposite directions, and the forward direction is not limited to a specific direction.

Thus, stress on the locking hole 811, 911 is relatively dispersed, thereby preventing a certain region of the washing tub 810, 910, to which the lifter is coupled, from being deformed. Effects according to an embodiment of the disclosure will be described based on comparison with the related art to be described later.

A corner 813, 913 of the locking hole 811, 911 is rounded having a predetermined diameter. This is to disperse the stress that may be focused on every corner 813, 913 of the locking hole 811, 911. Further, a predetermined gap may be formed between the left and right sides of the locking member 820, 920 and the left and right edges of the locking hole 811, 911, so that the locking member 820, 920 can be easily mounted to or separated from the locking hole 811, 911.

Figure 10:
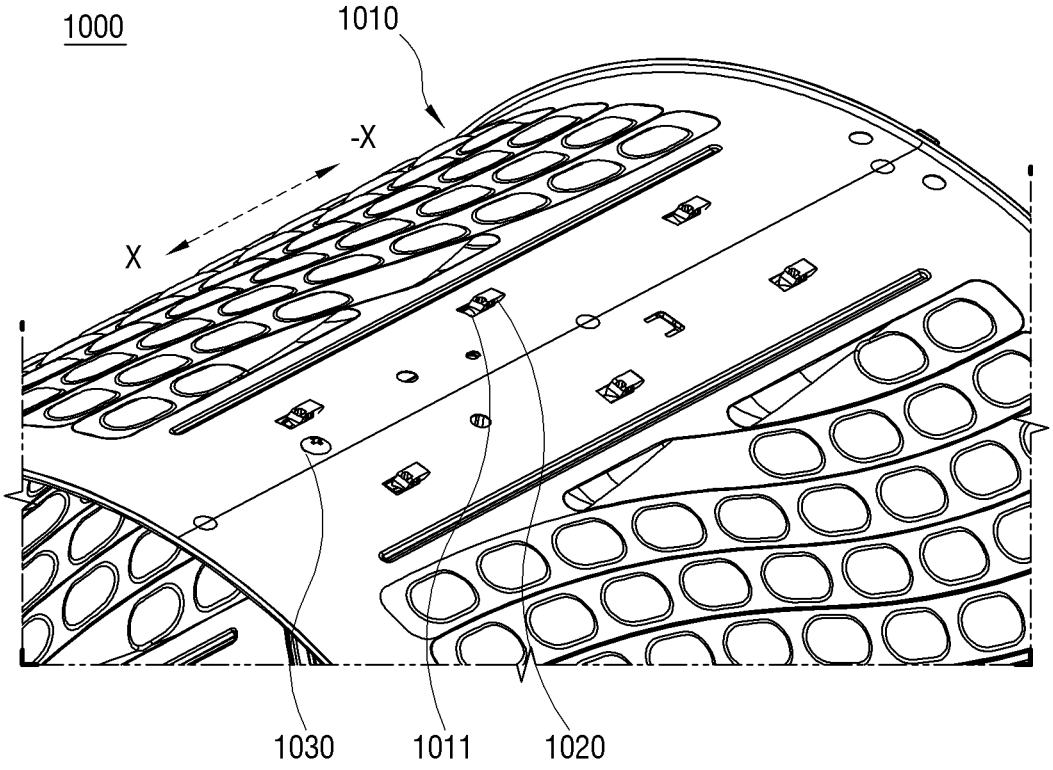
FIG. 10 is a partial perspective view showing a state that a lifter is completely coupled to a washing tub of a front-loading washing machine according to an embodiment of the disclosure.

FIG. 10 is a partial perspective view showing a state that a lifter is completely coupled to a washing tub of a front-loading washing machine according to an embodiment of the disclosure.

As shown in FIG. 10, a coupling portion for coupling with the lifter is formed on a wrapper 1010 of a washing tub 1000. The coupling portion includes a locking hole 1011 formed penetrating the wrapper 1010 and accommodating a locking member 1020 of the lifter, and a screw fastening hole formed penetrating the wrapper 1010 and corresponding to the fastening boss of the lifter. These elements have already been described above.

A plurality of locking holes 1011 are arranged to have a bilateral symmetry along the X directional axis line, and the locking members 1020 are coupled to the locking holes 1011 by the same method. A plurality of locking members 1020 have end portions facing in the same −X direction, and support regions of the wrapper 1010 on which the locking members 1020 are supported are regions forming the edges of the corresponding locking holes 1011 in the −X direction.

In the state that the locking members 1020 are supported by the corresponding locking holes 1011, the screw fastening hole of the wrapper 1010 and the fastening boss of the lifter are fastened together by a screw 1030. Alternatively, the fastening structure may be designed not to use the screw 1030.

When a user wants to separate the lifter from the washing tub 1000 for replacement or the like of the lifter, the foregoing process of coupling the lifter is reversely carried out. When a user pulls the lifter in the X direction, the end portion of the locking member 1020 is separated from the support regions and thus the locking member 1020 is positioned as shown in FIG. 7. When a user releases the locking member 1020 from the locking hole 1011 at the inside of the washing tub 1000, the lifter is separated from the washing tub 1000.

Meanwhile, for easy replacement of the lifter, easy separation of the screw 1030 may be additionally taken into account in the structure according to an embodiment. As described in the foregoing embodiment, the washing tub 1000 is accommodated in the water tank. To take off the screw 1030 from the washing tub 1000 under conditions that any special structure is not applied, a user has to first disassemble the water tank to expose the outer circumferential surface of the washing tub 1000.

However, when the screw fastening hole to which the screw 1030 is fastened is positioned corresponding to the position for coupling with the supplying pipe in the water tank, it is possible to fasten or release the screw 1030 without disassembling the water tank. The supplying pipe serves as a channel for supplying wash water to the water tank, and includes a water supplying hole communicating with the supplying pipe. When the supplying pipe is separated from the water tank, the water supplying hole is opened in the water tank so that a user can check the screw fastening hole through the water supplying hole. Thus, a user can easily release the screw from the screw fastening hole without disassembling the water tank. The water tank and the supplying pipe have already been described above with reference to FIG. 2.

Like this, according to an embodiment of the disclosure, the washing tub 100 is prevented from being deformed due to stress accumulated in the coupling region between the lifter and the washing tub 1000.

Below, for comparison with the coupling structure according to an embodiment of the disclosure, the coupling structure of the related art will be described.

Figure 11:
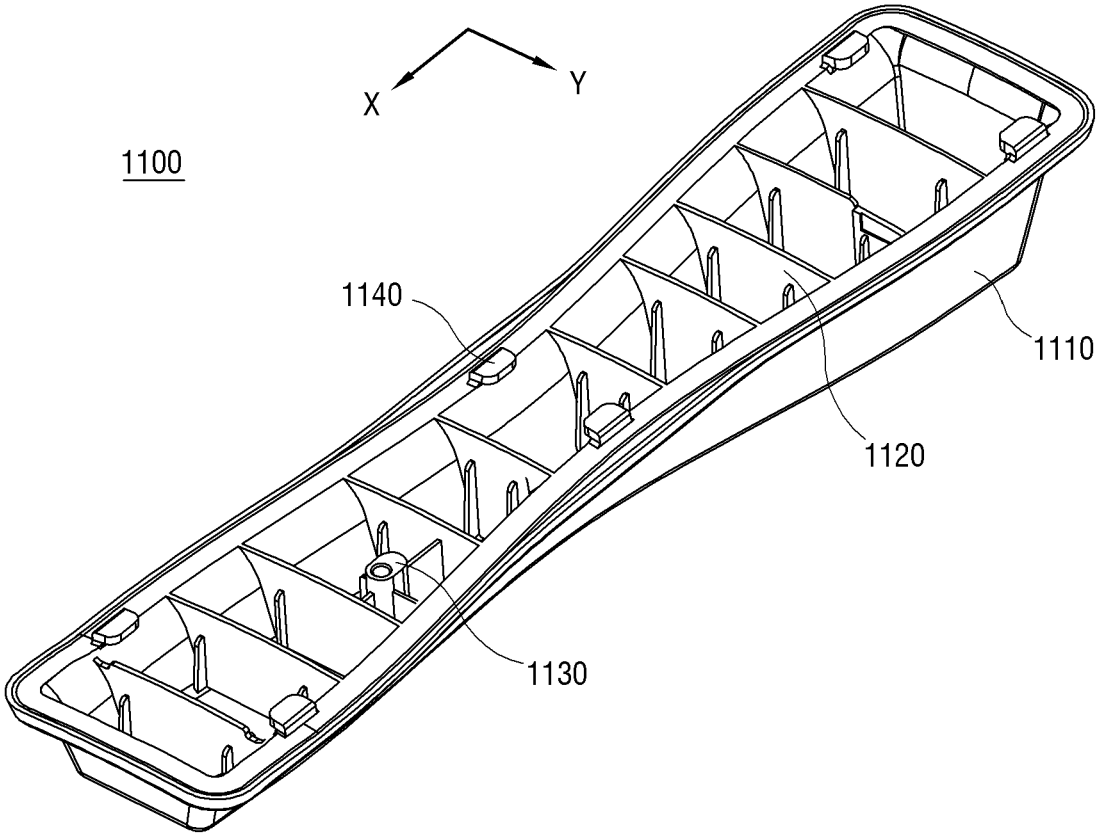
RELATED ART FIG. 11
FIG. 11 is a perspective view showing a bottom of a lifter used for a front-loading washing machine of the related art.

FIG. 11 is a perspective view showing a bottom of a lifter used for a front-loading washing machine of the related art.

As shown in FIG. 11, a lifter 1100 of the related art includes a lifter housing 1110 forming an outer appearance, a support rib 1120 supporting the lifter housing 1110 inside the lifter housing 1110, a fastening boss 1130 protruding from the bottom of the lifter housing 1110 and fastening with the screw, and a locking member 1140 protruding from the bottom of the lifter housing 1110 and coupled to the washing tub. The basic structure of the lifter housing 1110, the support rib 1120, and the fastening boss 1130 is substantially the same as that according to an embodiment of the disclosure. However, the lifter 100 of the related art is different in the structure of the locking member 1140 from that according to an embodiment of the disclosure.

In the accompanying drawing, the X direction and the Y direction orthogonal thereto are shown. Like the embodiment of the disclosure, the X direction is not only the lengthwise direction of the lifter 1100, but also the spinning axis direction of the washing tub. The Y direction is not only the widthwise direction of the lifter 1100, but also the radial direction of the washing tub.

The locking member 1140 of the related art is generally shaped like a hook, and has an end portion facing in the Y direction or the −Y direction. On the other hand, the end portion of the locking member according to an embodiment of the disclosure faces in the −X direction. In other words, the direction in which the end portion of the locking member 1140 of the related art faces is perpendicular to the spinning axis direction of the washing tub.

Below, a structure of the locking hole, to which the locking member 1140 of the related art is coupled, will be described.

Figure 12:
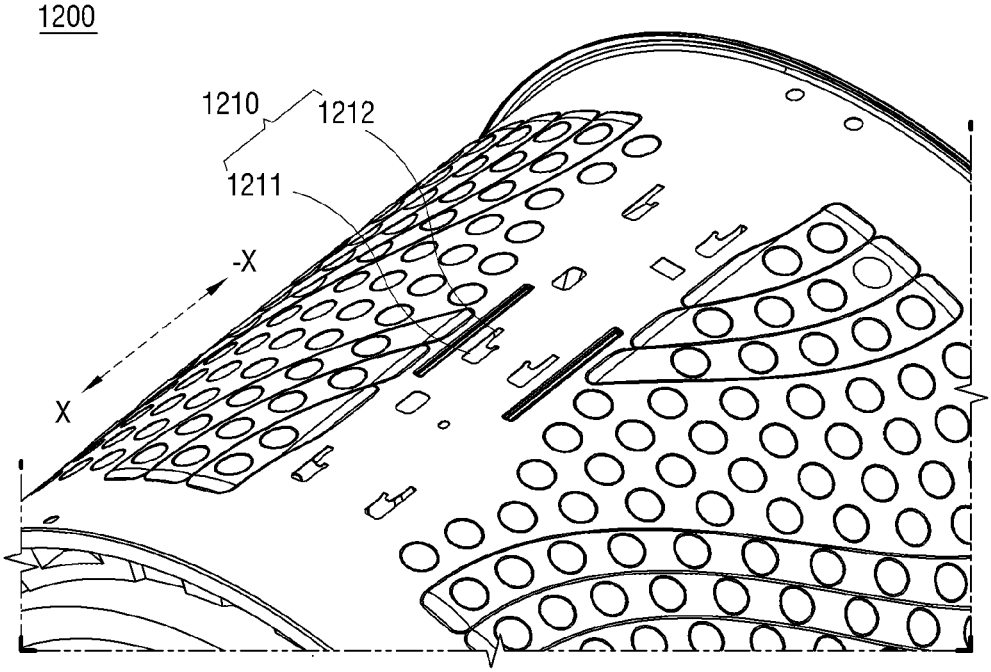
RELATED ART FIG. 12
FIG. 12 is a partial perspective view showing a coupling structure of a washing tub provided to couple with the lifter of the related art in FIG. 11.

FIG. 12 is a partial perspective view showing a coupling structure of a washing tub provided to couple with the lifter of the related art in FIG. 11.

As shown in FIG. 12, a locking hole 1210, to which the locking member of the lifter is coupled, is provided on the outer circumferential surface of a washing tub 1200 of the related art. The locking hole 1210 includes a first region 1211 through which the locking member passes from the inside of the washing tub 1200, and a second region 1212 in which the locking member accommodated in the first region 1211 moves in the −X direction and is supported. The first region 1211 and the second region 1212 communicate with each other, and the second region 1212 is positioned in the −X direction of the first region 1211.

Further, when the X direction is the lengthwise direction of the locking hole 1210, the left and right width of the second region 1212 is narrower than that of the first region 1211. In other words, the locking hole according to an embodiment of the disclosure has a bilateral symmetry with respect to the X directional axis line passing through the center thereof, but the locking hole 1210 of the related art has a bilateral asymmetry with respect to the X directional axis line. Further, the locking hole 1210 of the related art is longer than the locking hole according to an embodiment of the disclosure.

Due to such a structural difference, the region of the washing tub in which the locking member of the related art is supported is also different from that according to an embodiment of the disclosure.

Figure 13:
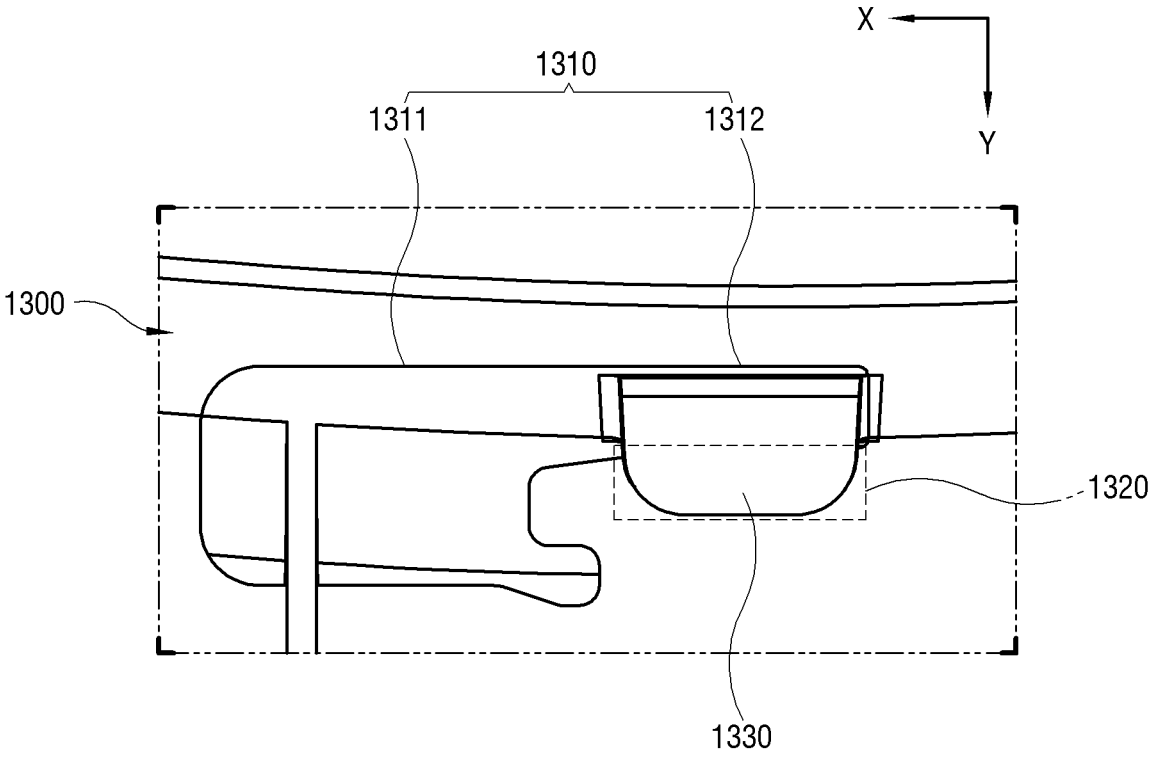
RELATED ART FIG. 13
FIG. 13 is a partial plan view showing a state that a locking member of a lifter in a front-loading washing machine of the related art is coupled to and supported by a locking hole of a washing tub.

FIG. 13 is a partial plan view showing a state that a locking member of a lifter in a front-loading washing machine of the related art is coupled to and supported by a locking hole of a washing tub.

As shown in FIG. 13, when the lifter is mounted from the inner circumferential surface of the washing tub 1300, a locking member 1330 of the lifter passes through a first region 1311 of a locking hole 1310 and appears on the outer circumferential surface of the washing tub 1300. The accompanying drawing shows the outer circumferential surface of the washing tub 1300 viewed from the outside of the washing tub 1300.

By external force, the locking member 1330 moves a first region 1311 to a second region 1312 in the −X direction. The second region 1312 is narrower than the first region 1311, and a region 1320 of the washing tub 1300 forming the edge in the Y direction of the second region 1312 serves to support the locking member 1330.

Comparison between the coupling structure of the related art and the coupling structure according to an embodiment of the disclosure is as follows. First, the hook-shaped end portion of the locking member 1330 of the related art faces in the Y direction perpendicular to the spinning axis direction of the washing tub 1300. The locking hole 1310 has a bilateral asymmetry with respect to the X directional axis line, and is relatively long. The support region of the washing tub 1300 supporting the locking member 1330 is formed at the edge in the Y direction of the second region 1312 of the locking hole 1310.

On the other hand, the hook-shaped end portion of the locking member according to an embodiment of the disclosure faces in the X direction, i.e. the spinning axis direction of the washing tub. The locking hole has a bilateral symmetry with respect to the X directional axis line, and is relatively short. The support region of the washing tub supporting the locking member is formed at the edge in the −X direction of the locking hole.

Due to such a structural difference, the coupling structure of the lifter and the washing tub according to an embodiment of the disclosure has effects as follows. The locking hole has a simple shape to thereby simplify manufacture. Although the support region of the washing tub keeps the same area as that of the related art, it is possible to relatively reduce the size of the locking hole. As the size of the locking hole is relatively decreased, the washing tub is prevented from deformation.

The effects according to an embodiment of the disclosure improved as compared with the related art are verified through various experiments. For example, under conditions that a load of 26.4 kg, a centrifugal force of 111 kN, a spinning speed of 1150 RPM, a wrapper thickness of 0.5 mm, etc. are given, the front-loading washing machine according to an embodiment of the disclosure and the front-loading washing machine of the related art are prepared. As difference between them, the front-loading washing machine according to an embodiment of the disclosure includes the locking hole having the size of 17×9 (mm), and the front-loading washing machine of the related art includes the locking hole having the size of 28×13 (mm). Besides, the structures of the locking holes are the same as those described above.

Under such conditions, the stress applied to the wrapper of the front-loading washing machine was as follows. The front-loading washing machine of the related art showed a stress of 311 MPa, but the front-loading washing machine according to an embodiment of the disclosure showed a stress of 235 MPa and thus has an effect on reducing the stress by 26%.

In other words, as the length of the locking hole, and more specifically, the length of the locking hole in the spinning axis direction of the washing tub gets shorter, the stress applied to the wrapper decreases, thereby preventing the wrapper from deformation with the decreased stress. The coupling structure according to an embodiment of the disclosure shortens the length of the locking hole as compared with the related art, thereby achieving the effects.

Meanwhile, to relatively reduce the length of the locking hole, the locking member and the locking hole may be designed to have a structure different from those of the foregoing embodiments. Below, such an embodiment will be described.

Figure 14:
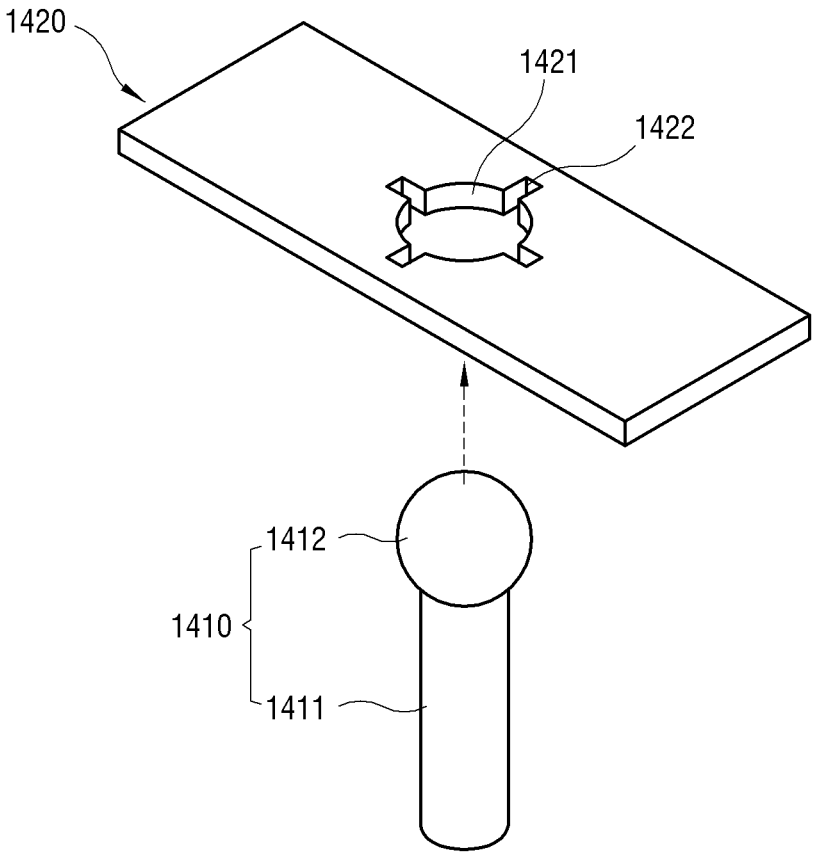
FIG. 14 is a partial perspective view showing a locking member of a lifter and a locking hole of a washing tub according to an embodiment of the disclosure.

FIG. 14 is a partial perspective view showing a locking member of a lifter and a locking hole of a washing tub according to an embodiment of the disclosure.

As shown in FIG. 14, a locking member 1410 of the lifter includes an erect portion 1411 extended toward a washing tub 1420, and an end portion 1412 having an outer diameter larger than the outer diameter of the erect portion 1411. The washing tub 1420 includes a locking hole 1421 of which some regions at edges are formed with one or more grooves 1422 cut in the radial direction of the locking hole 1421.

The grooves 1422 allow the regions of the washing tub 1420 around the locking hole 1421 to be elastically transformed by external force, so that the diameter of the locking hole 1421 can be extended. Because the outer diameter of the end portion 1412 is bigger than the outer diameter of the locking hole 1421, it may be difficult for the end portion 1412 of the locking member 1410 moving downward in the accompanying drawing to pass through the locking hole 1421 under the condition that the grooves 1422 are not given. When the locking member 1410 moves upward and the end portion 1412 enters the lower side of the locking hole 1421, the grooves 1422 allow the edges of the locking hole 1421 to be elastically transformed, thereby securing a space through the end portion 1412 passes through the locking hole 1421. When the end portion 1412 completely passes through the locking hole 1421, the edges of the locking hole 1421 are restored to their original state, thereby preventing the end portion 1412 from being separated in a lower side direction. Of course, when external force over the limit acts in the lower side direction, the end portion 1412 may be separated from the locking hole 1421 in reverse order of the foregoing coupling process.

The end portion 1412 in this embodiment has a spherical shape, but may be designed to have various shapes.

Figure 15:
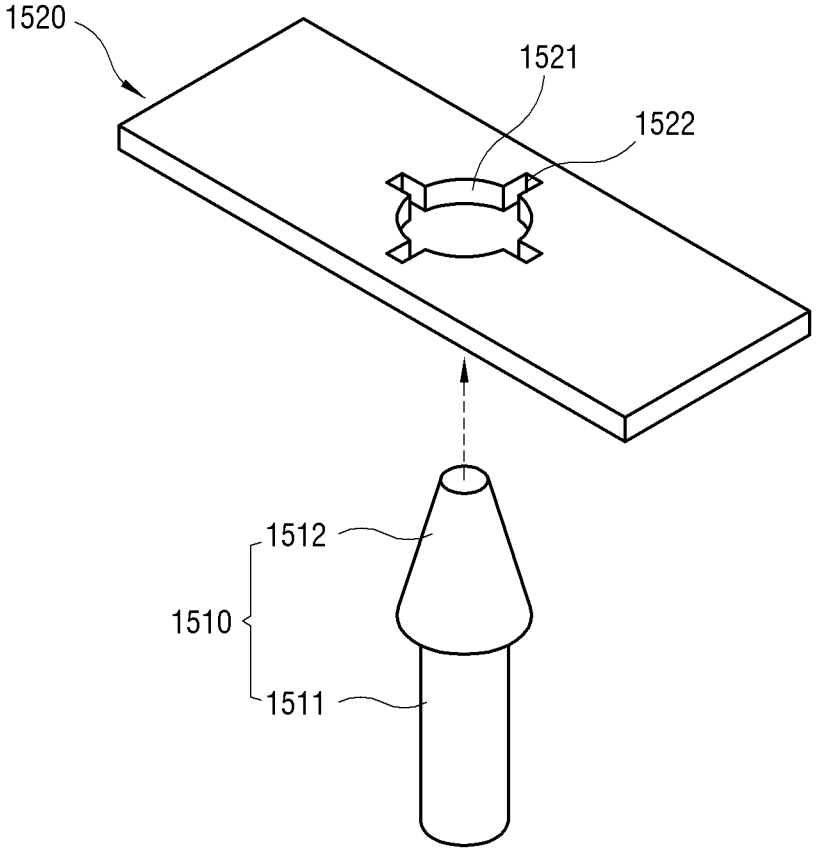
FIG. 15 is a partial perspective view showing a locking member of a lifter according to an embodiment of the disclosure, which is different from that of FIG. 14.

FIG. 15 is a partial perspective view showing a locking member of a lifter according to an embodiment of the disclosure, which is different from that of FIG. 14.

As shown in FIG. 15, a locking member 1510 of the lifter includes an erect portion 1511, and an end portion 1512. Further, a washing tub 1520 includes a locking hole 1521 and a groove 1522. The basic descriptions about these elements are equivalent to those of the foregoing embodiment, and thus repetitive descriptions will be avoided.

The end portion 1512 in this embodiment is different in shape from the end portion of the foregoing embodiment, and has a cone shape of which an upper portion is cut out. When the end portion 1512 is shaped like a cone, it is more easily coupled to the locking hole 1521 but more differently separated from the locking hole 1521 than that having the spherical shape. Like this, the end portion 1512 of the locking member 1510 may have various shapes.

As described in the foregoing embodiments, the size of the locking hole is important to prevent the wrapper from being deformed by the spinning of the washing tub in the state that the locking member of the lifter and the locking hole of the washing tub are coupled to each other. According to the foregoing embodiments, the locking hole is designed to be relatively small, thereby preventing deformation caused by stress accumulated in a certain region of the wrapper with respect to the locking hole.

However, according to experimental results, the small size of the locking hole is not simply effective. The size of the locking hole is representable with the length of the locking hole in parallel with the axial line direction of the washing tub, and the width of the locking hole perpendicular to the axial line direction of the washing tub. In terms of having the effects on preventing the wrapper from deformation, the length of the locking hole is important rather than the width of the locking hole.

According to the experimental data resulted from the locking holes different in only size under the same experimental conditions, the importance in the length of the locking hole is verified. For example, stress may be measured in eight cases of the locking holes different in "length× width" conditions of (28×13) mm, (22.5×13) mm, (17×13) mm, (12×13) mm, (7×13) mm, (28×9) mm, (22.5×9) mm and (17×9) mm the under the same conditions that a load of 26.4 kg, a centrifugal force of 111 kN, a washing tub spinning speed of 1,150 RPM, and a wrapper thickness of 0.5 mm are given. The results of the experiment showed the stress of 311 MPa, 283 MPa, 240 MPa, 202 MPa, 155 MPa, 316 MPa, 289 MPa and 235 MPa in the eight cases.

Four cases of (22.5×13) mm, (17×13) mm, (12×13) mm and (7×13) mm were respectively decreased in stress by 9%, 23%, 35%, 50% as compared with the stress 311 MPa of (28×13) mm. The case of (28×9) mm was increased in stress by 2%. The two cases of (22.5×9) mm and (17×9) mm were decreased in stress by 7% and 26%.

The foregoing results showed that the width of the locking hole has a marginal effect on decreasing the stress, but the length of the locking hole has a large effect. In this experiment, the stress was reduced by about 8 MPa when the length of the locking hole is decreased by 1 mm.

In relation to the length of the locking hole, the embodiment of the disclosure and the example of the foregoing related art may be compared. The related art is referred to by the descriptions of FIG. 11 to FIG. 13. For example, suppose that the locking hole of the related art has a size of (28×13) mm but the locking hole according to an embodiment of the disclosure has a size of (17×9) mm under the same conditions that a load of 26.4 kg, a centrifugal force of 111 kN, a washing tub spinning speed of 1,150 RPM, and a wrapper thickness of 0.5 mm.

According to the experimental results under such conditions, the locking hole of the related art showed the stress of 311 MPa, but the locking hole according to an embodiment of the disclosure showed a stress of 235 MPa. In other words, the locking hole according to an embodiment of the disclosure was more decreased in stress by 26% than that of the related art.

As verified by the foregoing experiments, the width of the locking hole has little effect on reducing the stress, but the length of the locking hole has an approximately linear effect on reducing the stress. Therefore, when the deformation of the wrapper still appears even though the size of the locking hole is designed to be decreased, the size of the locking hole may be designed to be additionally decreased as long as the lifter is firmly coupled to the wrapper.

For example, under the same condition that a load of 26.4 kg, a centrifugal force of 111 kN, a washing tub spinning speed of 1,150 RPM, and a wrapper thickness of 0.5 mm, the locking holes of (17×9) mm (15×9) mm may be designed and undergo experiment. As a result of the experiment, the case of (17×9) mm showed a stress of 235 MPa, and the case of (15×9) mm showed a stress of 218 MPa, the case of (15×9) mm is more decreased in stress by 7% than the case of (17×9) mm. Because the deformation of the wrapper is caused by the stress in the locking hole, no deformation of the wrapper is expected when the locking hole has a length causing the stress to be below about 250 MPa. With this, such a length of the locking hole may be below 17 mm.

The reason why the length of the locking hole directly affects the reduction of the stress is as follows. Pressure caused by spinning of when the washing tub spins is applied to the edge parallel to the lengthwise direction of the locking hole. The longer the edge parallel to the lengthwise direction, the more the room, in which the wrapper is movable in the radial direction of the spinning axis line of the washing tub, because of pressure. The shorter the edge parallel to the length wise direction, the less the room, in which the wrapper is movable in the radial direction of the spinning axis line of the washing tub, and therefore it is possible to prevent the deformation caused by the movement of the wrapper.

The invention claimed is:

1. A front-loading washing machine comprising:

a housing having a loading hole;

a door configured to open and close the loading hole;

a washing tub inside the housing, shaped like a cylinder, spinnable around a spinning axis, and positioned so that laundry is receivable into the washing tub through the loading hole when the loading hole is opened by the door, wherein the washing tub includes a locking hole including a first edge, a second edge, and a third edge, with the second edge and the third edge being adjacent to opposite ends of the first edge so that the second edge and the third edge face each other; and a lifter including a locking member that includes an erect portion erectly extending from a bottom of the lifter, and an end portion bent from the erect portion and having an inclined portion extending from a bottom of the end portion, wherein the locking member is configured to be insertable into the locking hole so that the end portion at least partially passes through the locking hole with the inclined portion inclined at an angle to a spinning axis direction of the spinning axis and facing the first edge, and the locking member is then movable so that the inclined portion contacts the first edge and then slides along the first edge so that the bottom of the end portion becomes in contact with an outer region of the washing tub forming the first edge, with the second edge and the third edge adjacent to opposite sides of the locking member, so that the lifter is thereby coupled to the washing tub and positioned inside the washing tub so as to be configured to lift laundry in the laundry tub based on spinning of the washing tub, with the second edge providing support to the locking member when the washing machine spins in a first direction and the third edge providing support to the locking member when the washing machine spins in a second direction opposite to the first direction.

2. The front-loading washing machine according to claim 1, wherein the locking hole has bilateral symmetry with respect to an axis line passing through a center of the locking hole in the spinning axis direction.

3. The front-loading washing machine according to claim 2, wherein the locking hole has a rectangular shape.

4. The front-loading washing machine according to claim 2, wherein the locking hole has corners rounded to have a predetermined diameter.

5. The front-loading washing machine according to claim 1, wherein the lifter includes a fastening boss protruding from the bottom of the lifter, and the washing tub includes a fastening hole configured to be fastened with the fastening boss by a screw.

6. The front-loading washing machine according to claim 5, further comprising a water tank including a water supplying hole to which a supplying pipe for supplying wash water is coupled, and accommodating the washing tub therein, wherein the fastening hole is positioned corresponding to a position of the water supplying hole.

7. The front-loading washing machine according to claim 1, wherein:

the end portion has a larger diameter than the erect portion, and the locking hole includes a groove cut in a radial direction of the locking hole from a partial edge of the locking hole.

* * * * *